US009223248B2

(12) United States Patent
Kawano et al.

(10) Patent No.: US 9,223,248 B2
(45) Date of Patent: Dec. 29, 2015

(54) IMAGE FORMING APPARATUS FOR IMAGE FAILURE PREVENTION

(71) Applicant: Oki Data Corporation, Minato-ku, Tokyo (JP)

(72) Inventors: Masahiro Kawano, Tokyo (JP); Takeshi Ishii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 65 days.

(21) Appl. No.: 13/955,744

(22) Filed: Jul. 31, 2013

(65) Prior Publication Data

US 2014/0037313 A1 Feb. 6, 2014

(30) Foreign Application Priority Data

Aug. 1, 2012 (JP) ..... 2012-170785

(51) Int. Cl.
*G03G 15/08* (2006.01)
*G03G 15/06* (2006.01)

(52) U.S. Cl.
CPC ..... *G03G 15/0848* (2013.01); *G03G 15/0808* (2013.01); *G03G 15/065* (2013.01)

(58) Field of Classification Search
CPC ..... G03G 15/0808; G03G 15/0848; G03G 15/065
USPC ..... 399/55, 281, 285
See application file for complete search history.

(56) References Cited

U.S. PATENT DOCUMENTS

| | | | | |
|---|---|---|---|---|
| 2009/0226197 | A1* | 9/2009 | Handa et al. | 399/55 |
| 2010/0303486 | A1* | 12/2010 | Shibata et al. | 399/55 |
| 2011/0097656 | A1* | 4/2011 | Mizobe | |
| 2012/0237253 | A1* | 9/2012 | Fukao et al. | |

FOREIGN PATENT DOCUMENTS

| | | | |
|---|---|---|---|
| JP | H09-171286 | A | 6/1997 |
| JP | 2002-006582 | A | 1/2002 |
| JP | 2004-029681 | A | 1/2004 |
| JP | 2009-098160 | A | 5/2009 |

* cited by examiner

*Primary Examiner* — David Gray
*Assistant Examiner* — Laura Roth
(74) *Attorney, Agent, or Firm* — Panitch Schwarze Belisario & Nadel LLP

(57) ABSTRACT

An image forming apparatus according to the invention includes a light source, an image carrier, a developer carrier, a supply member, and a controller. The light source emits light in accordance with printing data. The image carrier carries on a surface thereof a latent image based on the emitted light out of the light source. The developer carrier develops the latent image carried on the image carrier. The supply member supplies a developer to the developer carrier. The controller controls a voltage between the developer carrier and the supply member in accordance with a light emitting amount of the light source at a prescribed use amount.

17 Claims, 9 Drawing Sheets

511

| PRINT SHEET NUMBER | 0～500 | 501～1000 | 1001～5000 | 5001～10000 | 10001～ |
|---|---|---|---|---|---|
| \|DB-SB\|(V) | 100 | 110 | 120 | 130 | 135 |

IMAGE FORMING APPARATUS FOR IMAGE FAILURE PREVENTION

CROSS REFERENCE TO RELATED APPLICATION

This application claims priority benefits under 35 USC, section 119 on the basis of Japanese Patent Application No.2012-170785, the disclosure of which is incorporated herein by reference.

BACKGROUND OF THE INVENTION

1. Field of the Invention

This invention relates to an image forming apparatus such as a printer, a facsimile machine, etc.

2. Description of Related Art

In typical image forming apparatuses of electrophotographic method, a toner as a developer is supplied from a developing device to latent images formed on an image carrier to develop the images. The developing device includes a developing roller serving as a developer carrier for developing at least the latent image on the image carrier upon attaching the developer, and a toner supply roller serving as a supply member for supplying a triboelectrically charged toner to the developing roller while rotating as contacting to the developing roller.

Some device, among such developing devices, has been known as a device counting up the printing sheet number and changing a voltage between a developing roller and a toner supply roller according to the counted sheet number in order to prevent the toner amount attaching to the developing roller from being lowered when the printing sheet number is increased (see e.g., Japanese Patent Application Publication No. H09-171286).

With such a conventional image forming apparatus, however, image failures may occur in accordance with the toner consumption amount.

SUMMARY OF THE INVENTION

It is an object of the invention to provide an image forming apparatus preventing image failures from occurring.

To solve above problems, an image forming apparatus according to the invention includes a light source for emitting light in accordance with printing data, an image carrier carrying on a surface thereof a latent image based on the emitted light out of the light source, a developer carrier for developing the latent image carried on the image carrier, a supply member for supplying a developer to the developer carrier, and a controller for controlling a voltage between the developer carrier and the supply member in accordance with a light emitting amount of the light source at a prescribed use amount.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF EMBODIMENTS

Hereinafter, preferred embodiments of the invention are described in reference with drawings. This invention is not limited to those embodiments, and is modifiable as far as not deviated from the scope of the invention.

First Embodiment

Figure 1:
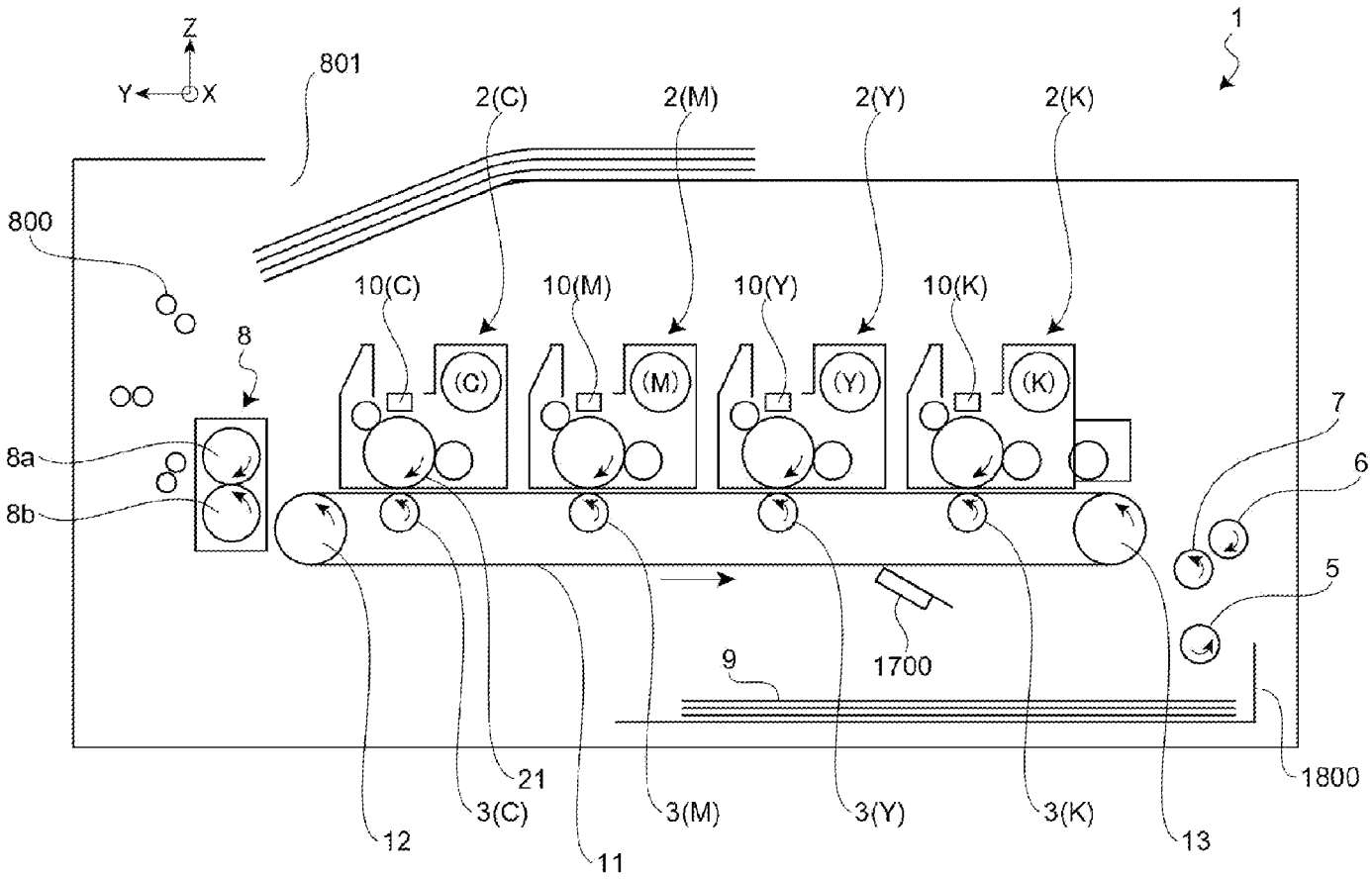
FIG. 1 is a schematic cross section showing a printer according to the invention.

FIG. 1 is a schematic cross section of a printer 1 serving as an image forming apparatus according to this embodiment. The printer 1 includes four developing devices for different colors, namely black (K), yellow (Y), magenta (M), and cyan (C). The printer 1 is an image forming apparatus of an electrophotographic method capable of forming images based on input printing data on paper 9 as recording medium. For the purpose of explanation, an axial direction of drums of developing devices described below is set as an X-axis; the conveyance direction of the paper 9 on a transfer belt 11 is set as an Y-axis; a direction perpendicular to those axes is set as Z-axis.

The printer 1 has a medium conveyance route formed in approximately extending in a shape of letter S with a start point of a paper cassette 1800 and an end point of a delivery stacker 801, via a pickup, or hopping, roller 5, a registration roller 6, a pinch roller 7, the transfer belt 11, and delivery rollers 800, and is formed with developing devices 2(K), 2(Y), 2(M), 2(C) and a fixing device 8, etc. along the medium conveyance route.

The paper cassette 1800 contains paper 9 inside in a stacking manner and is detachably attached to a lower portion of the printer 1. The hopping roller 5 provided above the paper cassette 1800 pickups sheet by sheet the paper 9 contained in the paper cassette 1800 from the topmost sheet to feed the paper 9 into the medium conveyance route.

The registration roller 6 and the pinch roller 7, as a pair, correct obliquely feeding of the paper 9 fed out of the hopping roller 5 and convey the paper 9 to the transfer belt 11.

The transfer belt 11 is an endless belt member conveying the paper 9 with static absorption. The transfer belt 11 is suspended by a tension roller 13 supported with a spring not shown to maintain the tension of this transfer belt 11 and by a drive roller 12 provided as a pair with the tension roller 13 for rotating by drive of a drive motor 67 described below. It is to be noted that a transfer belt cleaning blade 1700 is a rubber member made of, e.g., urethane, and one end thereof is arranged to contact a prescribed position on the surface of the transfer belt 11. The transfer belt cleaning blade 1700 makes clean the transfer belt 11 by scraping remaining toner on the transfer belt 11.

Delivery rollers 800 convey the paper 9 passing by the fixing device 8 upon nipping the paper 9, and deliver the paper 9 on the delivery stacker 801 formed in utilizing a housing of the printer 1.

Exposure devices 10(K), 10(Y), 10(M), 10(C) as light sources are LED heads, respectively, having LEDs (Light Emitting Diodes) and lens array. The exposure devices 10(K), 10(Y), 10(M), 10(C) are provided to be so positioned as to form images on the surface of the photosensitive drum serving as an image carrier with light emitted from LED devices based on control of the exposure section controller 61 as described below.

Developing devices 2(K), 2(Y), 2(M), 2(C) are developing devices corresponding to respective toner colors, black (K), yellow (Y), magenta (M), and cyan (C) as developers, and are detachably attached along a paper conveyance route. The developing devices 2(K), 2(Y), 2(M), 2(C) form toner images in attaching toner to latent images formed on the photosensitive drum surfaces equipped in the developing devices 2(K), 2(Y), 2(M), 2(C) with light emitted out of the exposure devices 10(K), 10(Y), 10(M), 10(C).

Transfer rollers 3(K), 3(Y), 3(M), 3(C) are provided as to press the photosensitive drums 21 serving as image carriers incorporated in the developing devices 2(K), 2(Y), 2(M), 2(C), respectively, in facing the drums via the transfer belt 11. The transfer rollers 3(K), 3(Y), 3(M), 3(C) transfer to the paper 9 the toner images formed on the photosensitive drum surfaces with the voltages applied from the transfer roller power source 60 as described below. The structure of the developing devices 2(K), 2(Y), 2(M), 2(C) is described later.

The fixing device 8 is disposed on a downstream side of the developing devices 2(K), 2(Y), 2(M), 2(C) in the paper conveyance route, and is equipped with a heating roller 8*a*, a backup roller 8*b*, a temperature sensor not shown, etc. The heating roller 8*a* is formed with a cylindrical hollow core metal made of, e.g., aluminum and covered with a heat resistance elastic layer made of a silicone rubber, on which a PFA (Tetrafluoroetylene-Perfluoroalkylvinylether Copolymer) tube is covered. A heater such as a halogen lamp is formed in the core metal. The backup roller 8*b* has a structure that a core metal made of, e.g., aluminum is covered with a heat resistance elastic layer made of a silicone rubber, on which a PFA is covered. The backup roller 8*b* is arranged so that a pressurized contact portion is formed between the backup roller 8*b* and the heating roller 8*a*. The heating roller 8*a* and the backup roller 8*b* rotate based on control of a fixing controller 62. The temperature sensor not shown is a member for detecting surface temperature of the heating roller 8*a* and is provided in non-contact but nearly with the heating roller 8*a*. On the basis of the detected consequence of the surface temperature of the heating roller 8*a*, which is detected by the temperature sensor not shown, the surface temperature of the heating roller 8*a* is maintained at a prescribed temperature by controlling the heating roller. Heat and pressure is given to the toner on the paper 9 where the paper 9 with toner images formed at and transferred from the developing devices 2(K), 2(Y), 2(M), 2(C) passes by a pressurized contact portion formed between the heating roller 8*a* maintained at the prescribed temperature and the backup roller 8*b*, thereby melting the toner to fix the toner images.

Figure 2:
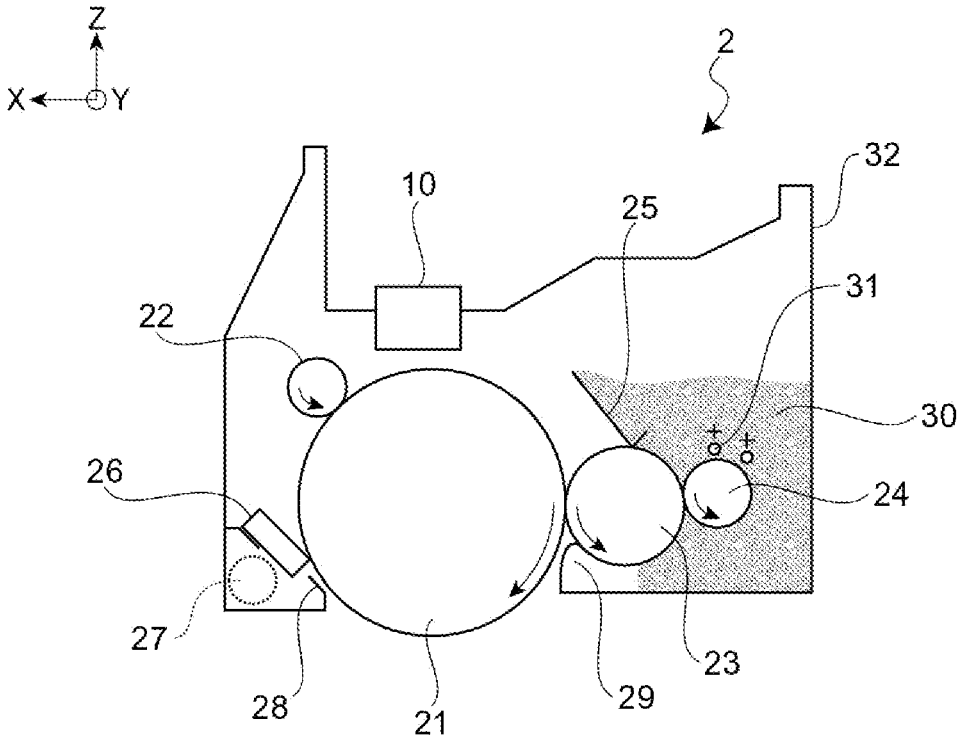
FIG. 2 is a schematic cross section showing a developing device according to the invention.

Referring to FIG. 2, the developing devices 2(K), 2(Y), 2(M), 2(C) are described next. FIG. 2 is a schematic cross section showing the developing devices 2(K), 2(Y), 2(M), 2(C). The developing devices 2(K), 2(Y), 2(M), 2(C) corresponding to respective toner colors have the common structure except different toners to be contained. Herein, the respective developing devices 2(K), 2(Y), 2(M), 2(C) are described without the alphabetic indication corresponding to toner colors.

The developing device 2 includes the photosensitive drum 21 serving as an image carrier, a developing roller 23 serving as an developer carrier, a toner supply roller 24 serving as a supplier member, a developing blade 25 as a layer limitation member, a cleaning blade 26, a waste toner conveyance spiral 27, a waste toner film 28, a developing film 29, toner 30 serving as a developer, a toner stirring member 31, and a mold 32.

The photosensitive drum 21 is made of a conductive support and a photoconductive layer and is, e.g., a negative charged multilayer photosensitive drum structured of a metal shaft made of such as aluminum serving as the conductive support, on which a charge generation layer and a charge transport layer are overlaid sequentially as the photoconductive layer. The outer diameter of the photosensitive drum 21 according to the embodiment is 30 mm, and the drum forms latent images based on the light emitted from the exposure device 10.

The charge roller 22 is made of, e.g., a stainless made metal shaft and a semiconductive epichlorohydrin rubber. The charge roller 22 has an outer diameter of 12 mm and is in contact with the photosensitive drum 21 with prescribed pressure to charge uniformly the photosensitive drum based on a bias voltage applied from a charge roller power source 57 described below.

The developing roller 23 is made of, e.g., a stainless made metal shaft and a urethane rubber arranged on an outer periphery and dispersed with carbon black, and has a surface isocyanate treated. The developing roller 23 has an outer diameter of 19.6 mm and is arranged in pressurized contact with the photosensitive drum surface in a manner pressed by the length of 0.1 mm. The developing roller 23 develops toner images as rotating by attaching the triboelectrically charged toner 30 to the latent images formed on the photosensitive drum surface. The developing roller 23 rotates in a driven direction with a rate of 1.25 times higher than that of the photosensitive drum 21.

The toner supply roller 24 is made of, e.g., a stainless made metal shaft and a semiconductive foamed silicone sponge layer arranged on an outer periphery of the shaft. The toner supply roller 24 has supplies, as rotating, the toner 30 supplied from a toner tank, not shown, to the developing roller 23 and collects remaining toner on the developing roller 23.

The developing blade 25 is a plate member formed upon folding, e.g., a stainless made metal plate having a thickness of 0.08 mm, whose one end is arranged as to contact the surface of the developing roller 23 at a prescribed position. The developing blade 25 limits the layer thickness of the toner supplied from the toner supply roller 24.

The cleaning blade 26 is, e.g., a urethane made rubber member, whose one end is arranged to contact the surface of the photosensitive drum at a prescribed position. The cleaning blade 26 makes the photosensitive drum surface clean by scraping the toner remaining on the photosensitive drum surface.

The waste toner conveyance spiral 27 is made of a metal spiral, and conveys the waste toner scraped off by the cleaning blade 26 to a waste toner reservoir, not shown.

The waste toner film 28 is a film member for preventing the waste toner scraped off by the cleaning blade 26 from leaking outside the developing device.

The developing film 29 is a film member for preventing the toner 30 near the developing roller 23 from leaking outside the developing device.

The toner 30 includes base particles and external additives, and the base particles include binder resin, colorant, wax, charge and controlling agent. According to the kinds of the toner, the addition amount of the external additive and the colorant for coloring images are made differently. Fine particles made of silica or titanium oxide in a size of several to several ten nanometers may be added as external additives for adjusting fluidity and charging feature. Organic colorants and metallic colorants have been known as types of the colorants, and a colorant using metal oxides has been known as metallic colorants. Titanium oxide is exemplified as one of the colorants made of the metallic oxides and is particularly used as a white colorant for whitening development.

The toner 30 according to this embodiment has a mean particle size of 5.5 micron meters, is made of non magnetic, one component produced through a grinding method, and is structured to be charged negative in terms of polarity after turboelectric charge is made.

The toner stirring member 31 is a member fabricated to be in a crank shape from a metal stick having a diameter of 2 mm, and is disposed to form a gap of 0.4 mm when coming mostly close to the toner supply roller 24. The toner stirring member 31 rotates in receiving drive force from a gear, not shown, provided on one end. In this embodiment, two of the toner stirring members 31 rotating in the same way are formed in each developing device 2.

The mold 32 is a cover member covering the entire developing device 2, for protecting the members inside the developing device 2 and for preventing the toner 30 from leaking outside the developing device 2.

Figure 3:
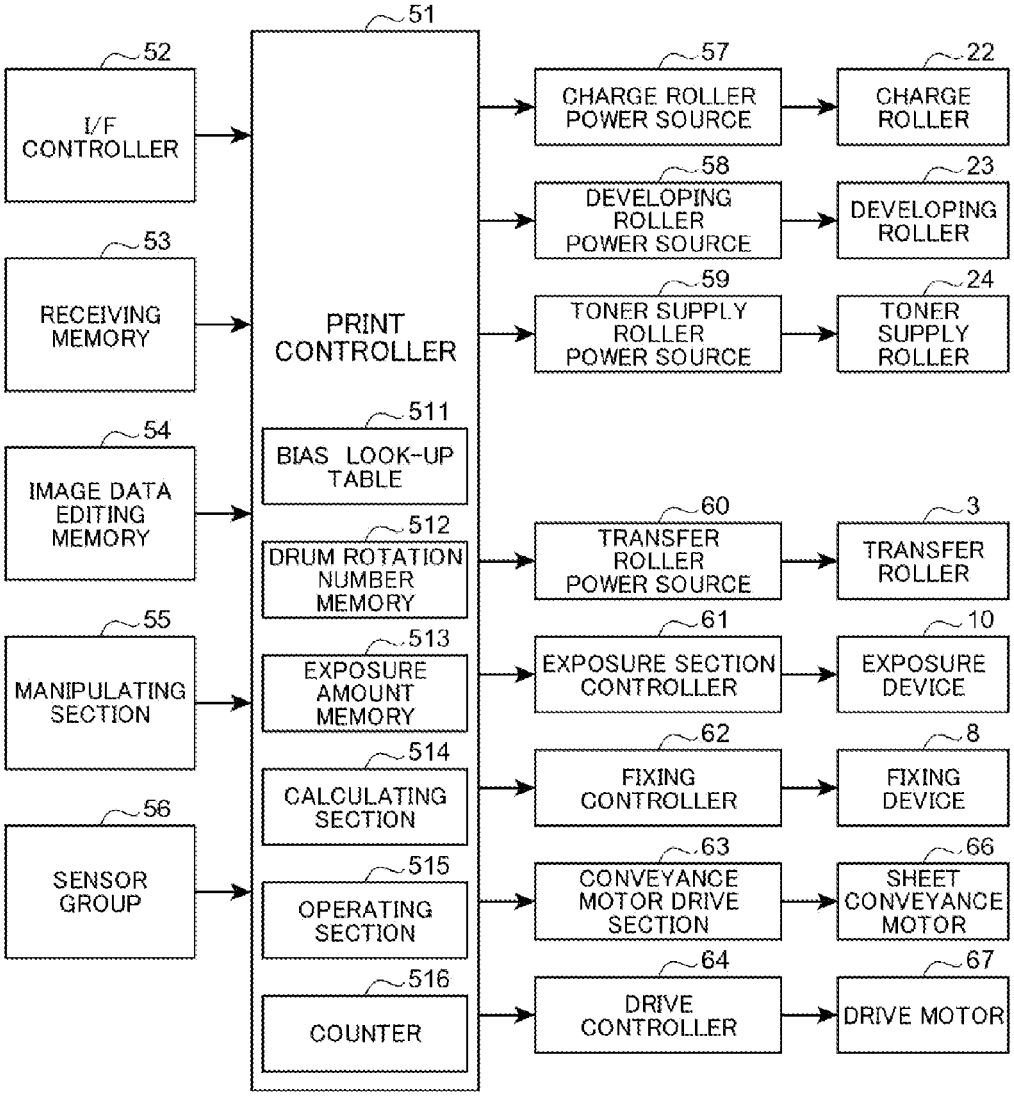
FIG. 3 is a block diagram showing a functional structure of the printer.

Referring to FIG. 3, the functional structure of the printer 1 is described.

The printer 1 includes a print controller 51 serving as a controller, an I/F controller 52, a receiving memory 53, an image data editing memory 54, a manipulation section 55, a sensor group 56, the charge roller power source 57, a developing roller power source 58, a toner supply roller power source 59, a transfer roller power source 60, an exposure section controller 61, a fixing controller 62, a conveyance motor drive section 63, and a drive controller 64.

The print controller 51 includes microprocessors, ROMs (Read Only Memories), RAMs (Random Access Memories), input and output ports, etc., receives printing data and control commands transmitted from a host apparatus not shown via the I/F controller 52, and performs printing operation in controlling the entire sequences of the printer 1. The internal structure of the print controller 51 is described later.

The I/F controller 52 includes a network controller and a control program for controlling this, and controls reception of the printing data and control commands from the host apparatus connected through electric signal lines such as LAN (Local Area Network) or the like.

The receiving memory 53 has, e.g., RAMs and rewritable memories such as flash memories and temporarily memorizes printing data received via the I/F controller 52.

The image data editing memory 54 reads out the printing data memorized in the receiving memory 53 and produces image data by editing processing of the read-out printing data to make recording.

The manipulating section 55 includes a display device such as LCD (Liquid Crystal Display) for displaying the operation state of the printer 1, a touch panel for receiving entries of manipulation inputs done by users, and an input means such as a switch.

The sensor group 56 includes such as, for monitoring the operation state of the printer 1, a paper position sensor, a temperature sensor, a humidity sensor, and a density sensor.

The charge roller power source 57 applies a prescribed voltage to the charge roller 22 based on an instruction from the print controller 51.

The developing roller power source 58 applies a prescribed voltage to the developing roller 23 based on an instruction from the print controller 51.

The toner supply roller power source 59 applies a prescribed voltage to the toner supply roller 24 based on an instruction from the print controller 51.

The transfer roller power source 60 applies a prescribed voltage to the transfer rollers 3(K), 3(Y), 3(M), 3(C) based on an instruction from the print controller 51.

The exposure section controller 61 controls drives of the exposure devices 10(K), 10(Y), 10(M), 10(C) and radiates, on the photosensitive drum surface, the radiation light based on the image data recorded in the image data editing memory 54.

The fixing controller 62 controls drives of the heating roller 8*a* and the backup roller 8*b* in the fixing device 8 for fixing the transferred toner images on the paper 9.

The conveyance motor drive section 63 controls drive of the paper conveyance motor 66 based on an instruction from the print controller 51 and conveys and stops the paper 9 by controlling rotations of the hopping roller 5, the registration roller 6, the pinch roller 7, and the delivery roller 800.

The drive controller 64 controls rotation of the photosensitive drum 21 by controlling drive of the drive motor 67 based on an instruction from the print controller 51.

An internal structure of the print controller 51 is described next.

The print controller 51 includes a bias look-up table 511, a drum rotation number memory 512, an exposure amount memory 513, a calculating section 514, an operating section 515, and a counter 516 serving as an accumulated use amount measuring section.

Figures 4, 5:
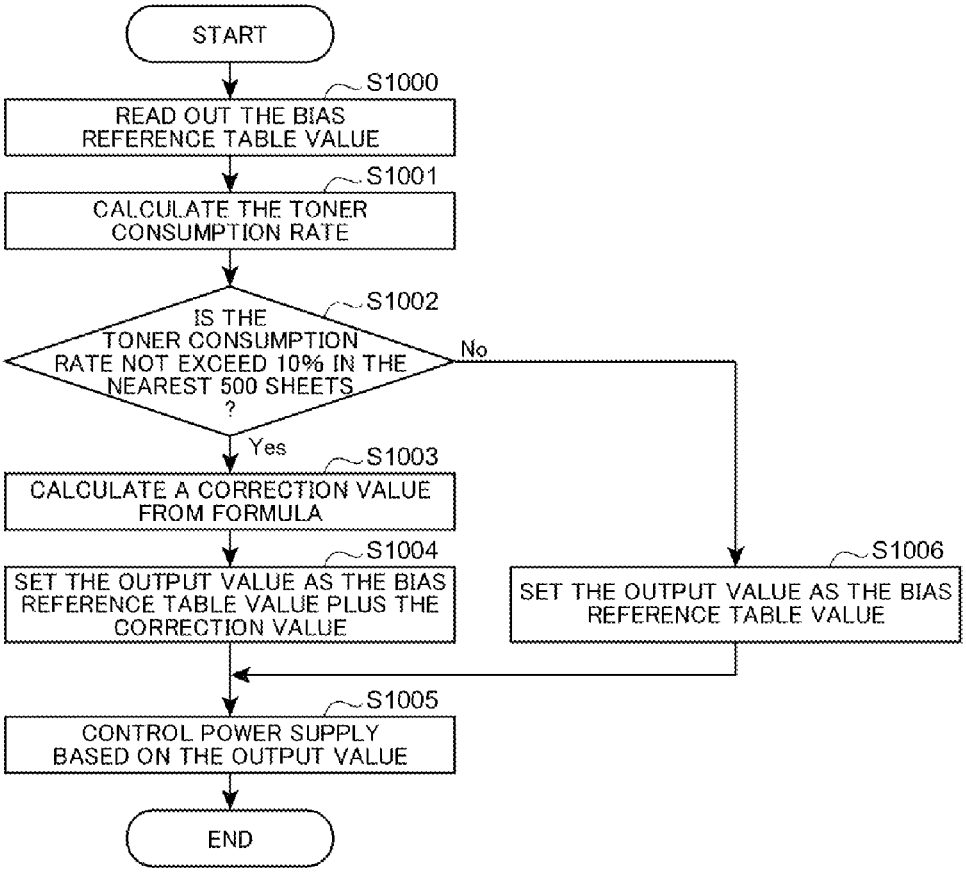
FIG. 4 is a diagram showing an example of a bias reference table.
FIG. 5 is a flowchart showing processing for control of a voltage applied between a developing roller and a toner supply roller.

The bias look-up table 511 is a referent of a value of |DB−SB|(V) as a potential difference between a voltage (DB) applied to the developing roller 23 preset in foreseeing member or material changes as time lapses and a voltage (SB) applied to the toner supply roller 24. The member changes as time lapses can be made corresponding to a prescribed use amount such as a printing sheet number or a rotation number of the developing roller 23. In FIG. 4, as the member changes as time lapses with respect to |DB−SB|(V), an example in which the printing sheet number is made corresponding is shown. In this embodiment, the print controller 51 looks up the value of |DB−SB|(V) in the bias look-up table 511 according to the prescribed rotation number of the developing roller. With the printer 1 according to this embodiment, where printing for 500 sheets is made with A4 paper landscape feeding in which a short length direction of the A4 paper is made as the proceeding direction, the developing roller 23 rotates in 4496 times, and the photosensitive drum 23 rotates in 2277 times. The print controller 51 looks up the value of |DB−SB|(V) in the bias look-up table 511 again at a time that the developing roller 23 rotates in 4496 times after previous looking up time of the table.

The drum rotation number memory 512 memorizes the rotation number of the photosensitive drum 21 from an arbitrary point of time to the time for looking up, which is counted by the counter 516.

The exposure amount memory 513 memorizes exposure dot numbers of the exposure devices 10(K), 10(Y), 10(M), 10(C) from an arbitrary point of time to the time for looking up.

The calculating section 514 calculates the mean toner consumption rate per unit sheet from the value memorized in the exposure amount memory 513 and the value memorized in the drum rotation number memory 512. The toner consumption rate is a ratio of an actually exposed dot number to an exposable dot number, and the calculating section 514 calculates the mean toner consumption rate with respect to a unit sheet number as a prescribed use amount or to a prescribed drum rotation number.

The operating section 515 operates a correction value to the value of |DB−SB|(V) retained in the bias look-up table 511 while having various operation formulas.

The counter 516 counts up, from an arbitrary point of time to the time for looking up, the rotation number of the photosensitive drum 21, the rotation number of the developing roller 23, and the printing sheet number.

The print controller 51 controls the developing roller power source 58 and the toner supply roller power source 59 so as to render the voltage between the developing roller 23 and the toner supply roller 24 a targeted voltage based on the value of |DB−SB|(V) retained in the bias look-up table 511 or the value added with the correction value obtained through operation at the operating section 515 with the value of |DB−SB|(V).

Next, image formation process at the printer 1 having the structure above is described.

First, the print controller 51 provides an instruction to the drive controller 54 and renders the photosensitive drum 21 rotate in a prescribed direction when receiving printing data from the host apparatus such as a personal computer via the I/F controller 52.

At the same time, the print controller 51 provides an instruction to the charge roller power source 57 for applying a prescribed voltage to the charge roller 22. The charge roller power source 57 applies the prescribed voltage to charge the photosensitive drum surface uniformly upon reception of the instruction.

Subsequently, the print controller 51 provides an instruction to the image data editing memory 54 for producing image data based on the printing data received and memorized in the receiving memory 53. The image data editing memory 54 receiving the instruction, reads out the printing data memorized in the receiving memory 53, and produces and records image data by editing the read-out printing data.

The exposure controller 61 controls drives of the exposure devices 10(K), 10(Y), 10(M), 10(C) and forms latent images upon radiating light emitted based on image data recorded in the image data editing memory 54, on the surface of the photosensitive drum.

The toner 30 contained in the toner cartridge not shown, is supplied to the developing roller 23 by the toner supply roller 24 applied with the prescribed voltage from the toner supply roller power source 59.

The developing blade 25 arranged at a prescribed position on the surface of the developing roller 23 forms the toner 30 supplied from the toner supply roller 24, in a uniform layer thickness. Toner images are developed by clinging the toner 30 to the latent image portions according to electrical flux lines corresponding to the latent images formed on the photosensitive drum surface between the developing roller 23 and the photosensitive drum 21. In this embodiment, the print controller 51 controls the voltage applied between the developing roller 23 and the toner supply roller 24. Processing for voltage control done by the print controller 51 is described below in detail.

The print controller 51, in association with developing operation of the toner images, provides an instruction to the conveyance motor drive section 63 for rotating the hopping roller 5, the registration roller 6, the pinch roller 7, and the delivery rollers 800. The conveyance motor drive section 63 receiving the instruction controls the drive of the paper conveyance motor 66 to rotate those rollers.

In accordance with rotation of the hopping roller 5, the paper 9 contained in a state accumulated on the paper cassette 1800 is fed to the paper conveyance route upon separated sheet by sheet from the topmost sheet. The registration roller 6 and the pinch roller 7 as a pair correct obliquely feeding of the paper 9 fed out of the hopping roller 5, and convey the paper 9 onto the transfer belt 11.

Each transfer roller 3(K), 3(Y), 3(M), 3(C) to which the prescribed voltage is supplied from the transfer roller power source 60, develops the toner image at the developing devices 2(K), 2(Y), 2(M), 2(C), respectively, and the toner image is sequentially transferred to the paper 9.

On the paper 9 with the transferred toner image, the toner 30 is melt due to heat applied from the heating roller 8*a* in the fixing device 8, and the toner image is fixed on the paper 9 in being pressed with the pressurized contact portion formed with the heating roller 8*a* and the backup roller 8*b*. The paper 9 on which the toner is fixed is delivered to the delivery stacker 801 upon rotation of the delivery roller 800, thereby reaching the end of the series of image formation process.

It is to be noted that the toner 30 more or less may remain on the photosensitive drum surface after the toner image is transferred. The remaining toner image 30 is removed with cleaning blade 26, and the cleaned photosensitive drum 21 is used repetitively.

Referring to the flowchart in FIG. 5, the processing for controlling the voltage applied between the developing roller 23 and the toner supply roller 24 is described herein.

The print controller 51 reads out the value in the bias look-up table 511 according to such as, e.g., the developing roller rotation number or the print sheet number, which indicates a use amount. In this flowchart, the print controller 51 reads out the value in the bias look-up table 511 at each of the developing roller rotation number of 4496 times or the print sheet number of 500 sheets (step S1000).

Subsequently, the print controller 51 renders the calculating section 514 calculate the mean toner consumption rate at the nearest 500-sheet printing (step S1001), and judges as to whether the calculated mean toner consumption rate is not more than 10% as the threshold value.

If the mean toner consumption rate at the nearest 500-sheet printing is not more than 10% (yes at step 1002), the print controller 51 calculates a correction value to the operating section 515 (step S1003).

The print controller 51 produces an output value by adding the correction value obtained through operation at the operating section 515 to the value in the bias look-up table 511 (step S1004).

To the contrary, if the mean toner consumption rate at the nearest 500-sheet printing, calculated at the calculating section 514, is more than 10% (no at step 1002), the print controller 51 makes the value in the bias look-up table 511 in association with the printing sheet number an output value (step S1006).

At step S1005, the print controller 51 controls, based on the output value, the developing roller power source 58 and the toner supply power source 59 so as to render the voltage between the developing roller 23 and the toner supply roller 24 the targeted voltage (step S1005).

As described above, in this embodiment, the voltage applied to the developing roller 23 and the toner supply roller 24 is changed in accordance with member or material changes as time lapses. This is because the supply amount of the toner 30 from the toner supply roller 24 to the developing roller 23, and the scraping amount as well, may be changed as time lapses due to deteriorations of the members or materials of the toner 30, the developing roller 23, and the toner supply roller 24, and therefore, it is necessary to correct the voltage.

Figure 6:
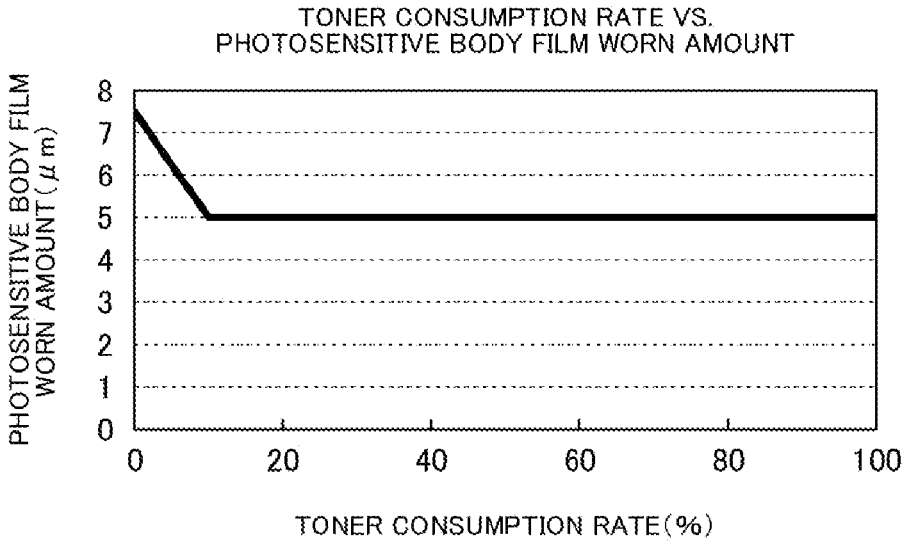
FIG. 6 is a diagram showing a relationship between mean toner consumption rate and film worn amount on a photosensitive drum surface.

FIG. 6 shows a relationship of film worn amount on the photosensitive drum surface at respective toner consumption rates in a case where no member or material change as time lapses is considered, or namely where any correction is not made to the value of |DB−SB|(V). The term of the "film worn amount" means an amount of a photosensitive layer worn away from the roller surface or drum surface. As shown in FIG. 6, as the mean toner consumption rate falls down to 10% or less, the film worn amount becomes increasing. This is caused by friction at the contact portion between the photosensitive drum surface and the developing roller surface, and caused by the external additive of the toner 30 on the developing roller 23, which serves as abrasive or the like.

If the mean toner consumption is not more than 10%, the toner 30 inside the developing device 2 keeps receiving stress. The term of "stress" herein refers to the entire pressures received by the toner 30 passing through the contact portion between the photosensitive drum 21 and the developing roller 23, the contact portion between the developing roller 23 and the toner supply roller 24, and the contact portion between the developing roller 23 and the developing blade 25. If the toner 30 keeps receiving such stresses, the external additive on the toner surface may be detached or embedded, thereby increasing interaction among particles of the toner 30. Consequently, the developing blade 25 reluctantly limits the toner layer thickness or toner amount, and the toner supply roller 24 hardly collects undeveloped toner 30 on the developing roller surface, thereby increasing the toner amount on the developing roller surface. Such interaction among particles of toner may become outstanding where the mean toner consumption rate is not more than 10%.

Figure 7:
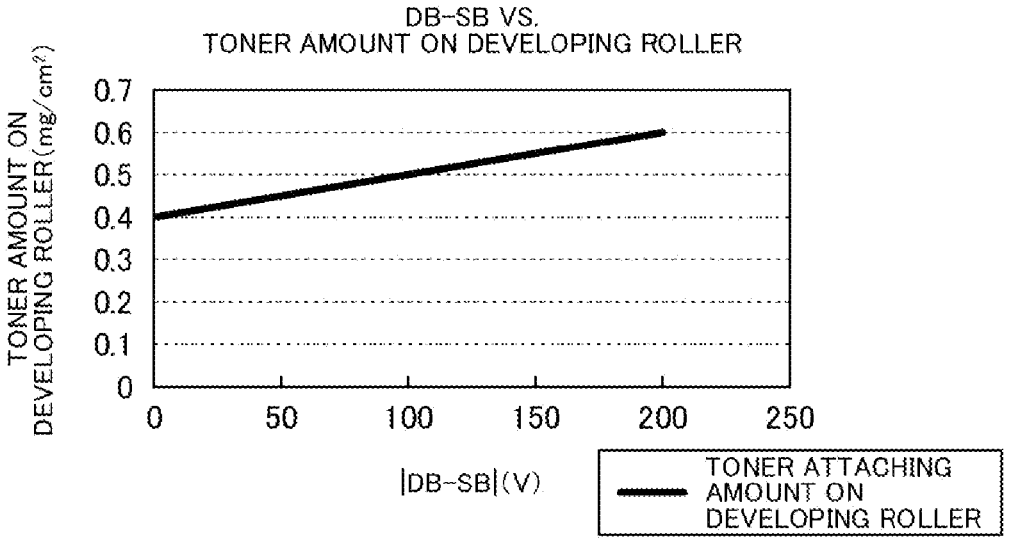
FIG. 7 is a diagram showing a relationship between toner amount on the developing roller surface and value of |DB−SB|(V)

In the developing device 2, however, the toner amount on the developing roller surface is controllable by adjusting the value of |DB−SB|(V) as the voltage applied to the developing roller 23 and to the toner supply roller 24. FIG. 7 shows a relationship between the toner amount on the developing roller surface and the value of |DB−SB|(V). As shown in FIG. 7, it turns out that the toner amount on the developing roller surface increases as the value of |DB−SB|(V) increases. This is because, if the value of |DB−SB|(V) changes, intensity of the electric field changes, though the limiting ability for toner layer thickness done by the developing blade 25, as well as collection ability of the toner supply roller 24 for the undeveloped toner 30 on the developing roller surface are not changed, and because the toner supply amount from the toner supply roller 24 to the developing roller 23 changes.

Accordingly, increasing of the toner amount on the developing roller surface in a case that the mean toner consumption rate is low is avoidable by making a correction such that the value of |DB−SB|(V) becomes small. At that time, it is desirable to perform operation to change the correction amount of the value of |DB−SB|(V) according to the mean toner consumption rate. If the value of |DB−SB|(V) is made too small as the correction value, however, the toner supply amount becomes short, thereby generating burrs, so that it is desirable to control with a proper range while it is not desirable to set the value of |DB−SB|(V) as zero.

In this embodiment, the mean toner consumption rate is calculated at each of the prescribed rotation number of the developing roller 23, or namely, 4496 times or 500 sheet printing in A4 paper landscape feeding, and no correction is added where the value of the calculated mean toner consumption rate is large (or more than 10%) while a correction is added to a subsequent developing roller scheduled rotation number where the value of the calculated mean toner consumption rate is small (or not more than 10%). If the printing sheet number is around a several number, it is almost impossible to detect deterioration of the toner, and if the printing sheet number is from several sheets to several ten sheets, the toner 30 deteriorated due to time lapsing may not be replaced. Therefore, it is not required to make a correction for short printing intervals such as the printing sheet number from several sheets to several ten sheets, so that, in this embodiment, it has a feature to judge the necessity of the correction based on the calculated mean toner consumption rate where calculating the mean toner consumption rate at each of the developing roller rotation number of 4496 times or 500-sheet printing.

Figure 8:
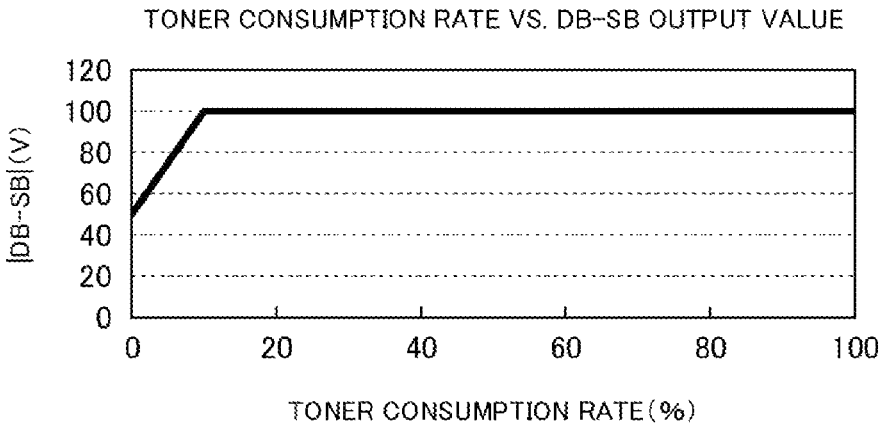
FIG. 8 is a diagram showing a relationship between mean toner consumption rate and value of |DB−SB|(V)

Thus, from making the correction of the value of |DB−SB|(V) based on the calculated mean toner consumption rate, this apparatus shows a relationship between the mean toner consumption rate and the value of |DB−SB|(V) as shown in FIG. 8 where, e.g., the value of |DB−SB|(V) at the prescribed rotation number of the developing roller 23, which is retained in the bias look-up table 511 and referred hereinafter to as pre-correction |DB−SB|(V), is set to 100 (V). In a case where the toner consumption rate is not more than 10% in FIG. 8, a change amount of |DB−SB|(V) as the correction value is operated from a formula represented with change amount of |DB−SB|(V)=−5×the mean toner consumption rate +50. Hereinafter, where the change amount of |DB−SB|(V) serving the correction value is referred to as "B" while the value of pre-correction |DB−SB|(V) is referred to as "A," the post-correction |DB−SB|(V) is set as the post-correction |DB−SB|(V)=A+(−B). If the value of the pre-correction |DB−SB|(V) is set to 100 (V), the post-correction |DB−SB|(V) is set as the post-correction |DB−SB|(V)=A−B=100-(-5×the mean toner consumption rate+50).

Figure 9:
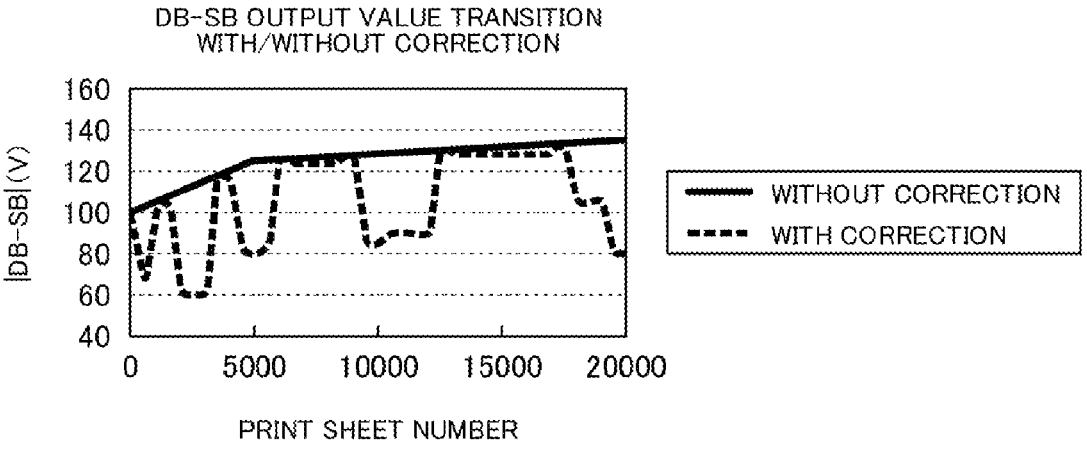
FIG. 9 is a diagram showing transition of value of |DB−SB|(V)
Figure 10:
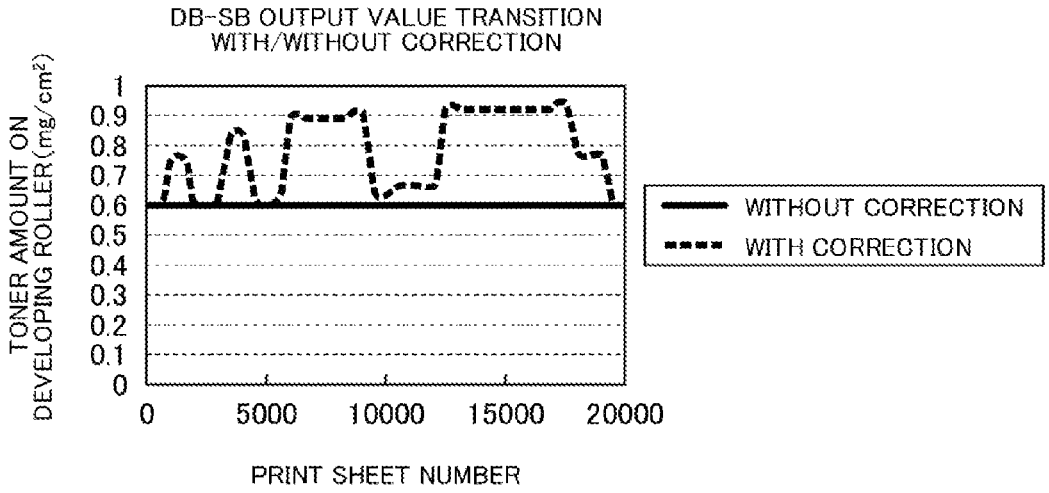
FIG. 10 is a diagram showing transition of toner amount on the developing roller surface with and without correction of value of |DB−SB|(V) as time lapses.

FIG. 9 shows a graph of a transition of the value of the post-correction |DB−SB|(V) where a correction is added to the pre-correction |DB−SB|(V) as time lapses based on the above formula, and FIG. 10 shows a transition of toner amount on the developing roller surface with and without a correction of the pre-correction |DB−SB|(V) as time lapses. As apparent from FIG. 10, the toner amount on the developing roller becomes stable by adding the correction to the value of the pre-correction |DB−SB|(V) as time lapses.

Figure 11:
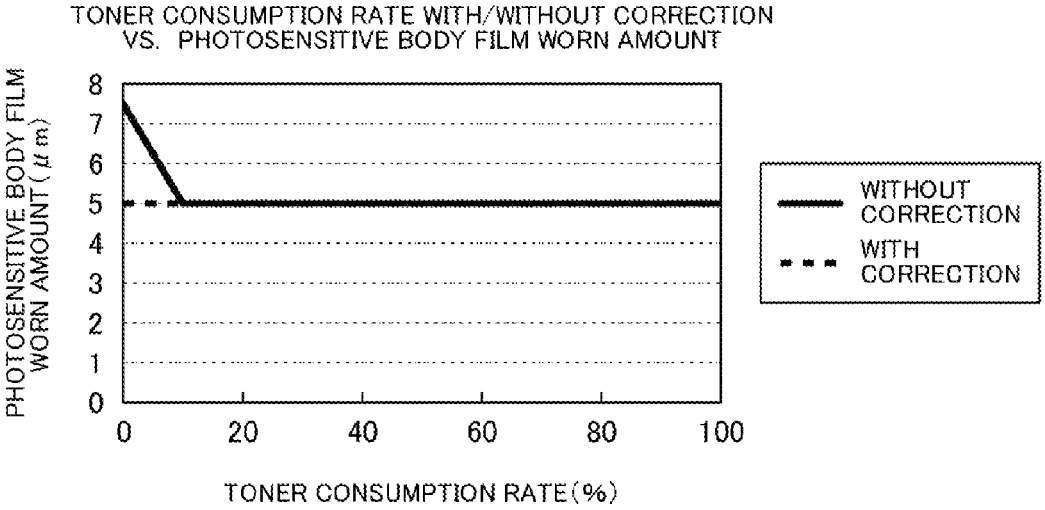
FIG. 11 is a diagram showing a relationship between mean toner consumption rate and film worn amount on a photosensitive drum surface.

As shown in FIG. 11, the film worn amount on the photosensitive drum surface becomes better by the stable toner amount on the developing roller surface in comparison with that in a case that no correction is made, even where the mean toner consumption rate is small.

The film worn amount on the photosensitive drum surface after 20000-sheet printing may be different according to toner types contained in the developing devices 2(K), 2(Y), 2(M), 2(C) (photosensitive drum 21(K), 3.3 microns; 21(Y) 3.2 microns; 21(M), 5.7 microns; 21(C) 2.9 microns). According to this embodiment, however, with preparation of formulas corresponding to respective toners, the film worn amounts on the photosensitive drum surface can be improved to suppress occurrences of image failures even where toners having different amounts of colorants or external additives are used.

Second Embodiment

In the first embodiment, the printer is described in which the mean toner consumption rate is calculated at each of the prescribed rotation number of the developing roller 23 (4496 times, 500 sheet printing in A4 paper landscape feeding), and in which no correction is added where the value of the calculated mean toner consumption rate is larger, i.e., more than 10% whereas a correction is added to a subsequent developing roller scheduled rotation number where the value of the calculated mean toner consumption rate is small, i.e., equal to or less than 10%; the printer can improve the film worn amount on the photosensitive drum surface and can suppress occurrences of image failures even where the toner types are different from each other.

Figure 12:
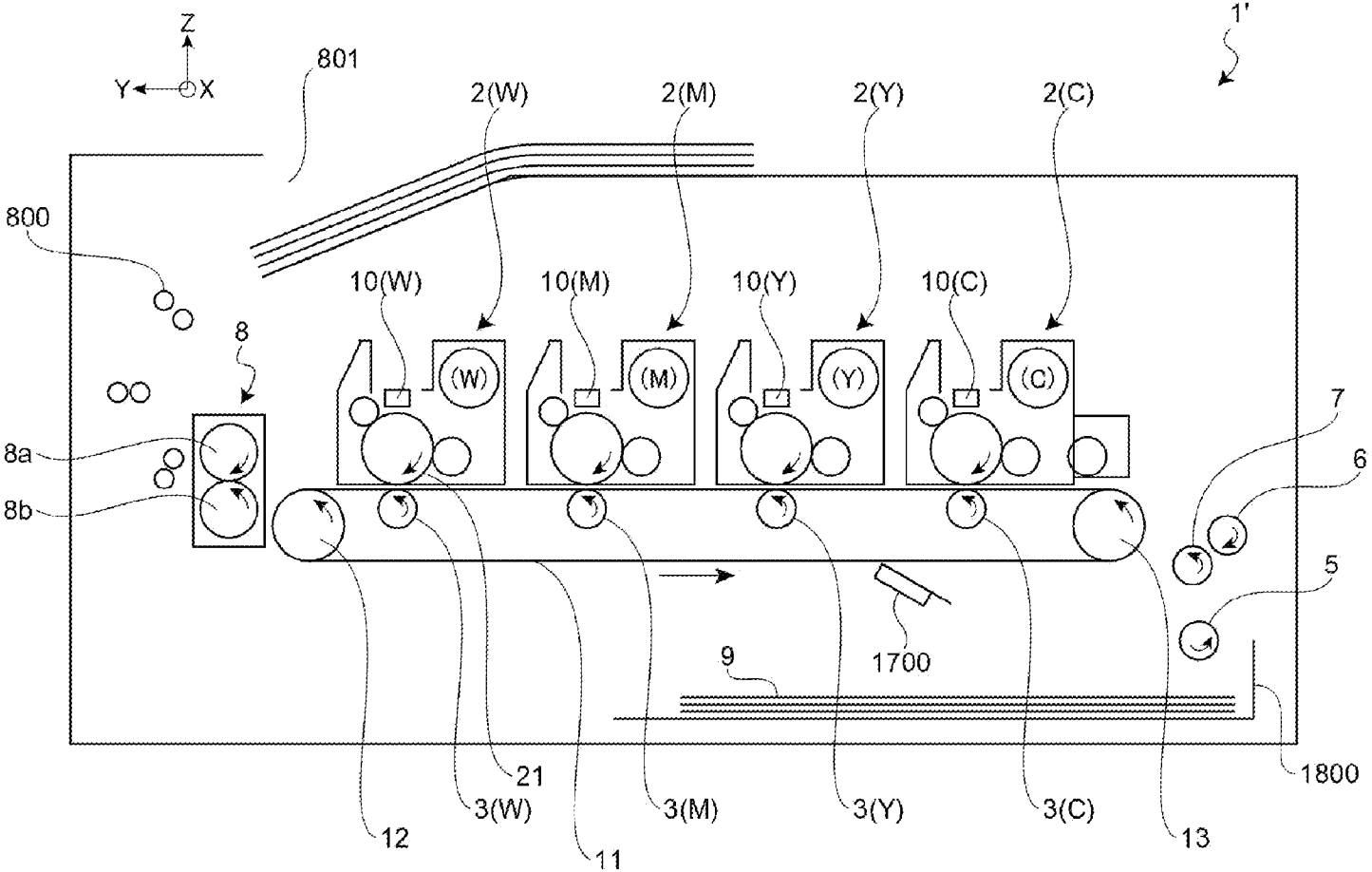
FIG. 12 is a schematic cross section showing another printer according to the invention.

In the second embodiment, more specifically, an example utilizing a developing device 2(W) containing white toner in which titanium oxide as a metal oxide is used a white colorant, instead of the developing device 2(K) described in the first embodiment, is described. In this embodiment, the arrangement order of the developing devices 2(Y), 2(M), 2(C) as the first developing units and the developing device 2(W) as the second developing unit is changed to 2(C), 2(Y), 2(M), and then 2(W) from the upstream side to the downstream side in the paper conveyance direction, as shown in FIG. 12.

It is to be noted that other structures and operations are assigned with the same reference numbers as those in the first embodiment, and a detailed description is omitted for the sake of simplicity.

In a case of the white toner, the film worn amount on the photosensitive drum surface was about two times larger in comparison with other toners (C: cyan, Y: yellow, M: magenta). The reason is thought that the white toner uses titanium oxide as a metallic colorant having a harder hardness than organic colorants, which are used in the cyan toner, the yellow toner, and the magenta toner. In addition, the metallic colorant is generally having a lower resistance than the organic colorants, so that changes of the toner amount on the developing roller surface in accordance with changes of the value of |DB−SB|(V) are half of those of the organic colorants.

In this embodiment, the formula is altered to make twice the correction from the mean toner consumption amount in the formula obtaining the value of the post-correction |DB−SB|(V) described in the first embodiment. That is, it is set that the post-correction |DB−SB|(V)=A−B=100−(−10×the mean toner consumption rate+100).

Figure 13:
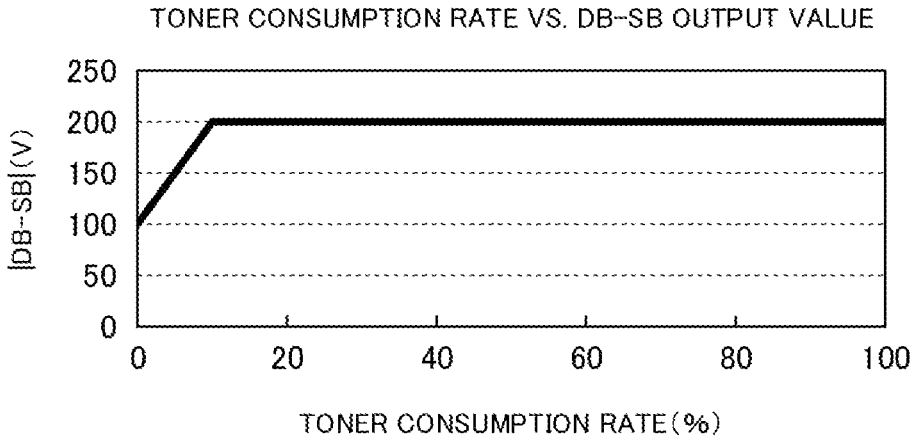
FIG. 13 is a diagram showing a relationship between mean toner consumption rate and value of |DB−SB|(V).

FIG. 13 is a graph showing a relationship between the mean toner consumption rate and the value of |DB−SB|(V) according to this embodiment. In this embodiment, by adding the correction to the value of |DB−SB|(V) where the value of the mean toner consumption amount is low as described with FIG. 8 in the first embodiment, this apparatus prevents the toner amount on the developing roller surface from increasing, thereby improving the film worn amount on the photosensitive drum.

Accordingly, with this embodiment, even where the toner colorant is changed from the organic colorant to the metallic colorant, the film worn amount on the photosensitive drum surface is improved, thereby suppressing occurrences of image failures.

Although in the embodiments above, the printers are exemplified as an image forming apparatus, this invention is not limited to that and is applicable to other image forming apparatuses using electrophotographic methods such as facsimile machines and multifunction peripherals (MFP), etc.

What is claimed is:

1. An image forming apparatus comprising:

a first developing unit utilizing a first developer;

a second developing unit utilizing a second developer;

a first light source for emitting light in accordance with printing data, the first light source corresponding to the first developing unit;

a second light source for emitting light in accordance with printing data, the second light source corresponding to the second developing unit;

the first developing unit includes:

a first image carrier carrying on a surface thereof a latent image based on the emitted light;

a first developer carrier for developing the latent image on the image carrier; and a first supply member for supplying a first developer to the first developer carrier, wherein the first developer includes an organic colorant;

the second developing unit includes:

a second image carrier carrying on a surface thereof a latent image based on the emitted light;

a second developer carrier for developing the latent image on the image carrier; and a second supply member for supplying a second developer to the second developer carrier, wherein the second developer includes a metallic colorant, and a controller for controlling a first voltage between the first developer carrier and the first supply member and a second voltage between the second developer carrier and the second supply member in accordance with a measured use of the image forming apparatus, wherein:

if a first developer consumption rate corresponding to the measured use is below a threshold value, a first correction value is applied to the first voltage between the first developer carrier and the first supply member, and if a second developer consumption rate corresponding to the measured use is below the threshold value, a second correction value is applied to the second voltage between the second developer carrier and the second supply member, and wherein the second correction value is greater than the first correction value.

2. The image forming apparatus according to claim 1, further comprising:

a calculating section for calculating the first developer consumption rate and the second developer consumption rate, corresponding to the measured use; and an operating section for operating first and second correction values by using the respective first and second developer consumption rates calculated at the calculating section, wherein the controller controls the first voltage and the second voltage by using the result from the calculating section and the operating section.

3. The image forming apparatus according to claim 2, wherein the measured use is a prescribed rotation number of the first developer carrier or the second developer carrier.

4. The image forming apparatus according to claim 2, wherein the measured use is a prescribed number of recording medium sheets to which the developer image is transferred.

5. The image forming apparatus according to claim 4, wherein the prescribed number is not less than 100.

6. The image forming apparatus according to claim 5, wherein the prescribed number of recording medium sheets is 500.

7. The image forming apparatus according to claim 2, wherein the first developer consumption rate is a ratio of an actually exposed dot number to an exposable dot number, associated with the first developing unit, and wherein the second developer consumption rate is a ratio of an actually exposed dot number to an exposable dot number, associated with the second developing unit.

8. The image forming apparatus according to claim 2, wherein, if at least one of the calculated first developer and second developer consumption rates is less than a second threshold value, the controller increases the first voltage and the second voltage, wherein the increased voltage is less than that in a case where the consumption rate is not less than the threshold value.

9. The image forming apparatus according to claim 8, wherein the controller increases the voltage by adding at least one of:

the first correction value obtained using the first developer consumption rate, and the second correction value obtained using the second developer consumption rate, to the first voltage and the second voltage.

10. The image forming apparatus according to claim 2, further comprising a measured use measuring section for measuring the measured use, wherein the calculating section calculates the first and second consumption rates at each time when the measured use reaches a third threshold value.

11. The image forming apparatus according to claim 1, wherein the second developer includes a white colorant.

12. The image forming apparatus according to claim 1, wherein the metallic colorant is a metallic oxide.

13. The image forming apparatus according to claim 12, wherein the metallic oxide is titanium oxide.

14. The image forming apparatus according to claim 1, wherein the first voltage and the second voltage are calculated according to the number of printing sheets and the consumption rate.

15. The image forming apparatus according to claim 1, wherein the smaller a value of at least one of the first and second consumption rates, the smaller an absolute value of the first voltage or the second voltage becomes, wherein the absolute value corresponds to the smaller value of the at least one of the first and second consumption rates.

16. The image forming apparatus according to claim 1, wherein the second correction value of the second voltage of the second developing unit is greater than the first correction value of the first voltage of the first developing unit with respect to the consumption rate.

17. The image forming apparatus according to claim 1, wherein, when at least one of the first consumption rate and the second consumption rate, is below the threshold value, a correction is performed in accordance with the respective one of the first and second consumption rate, and when the at least one of the first consumption rate and the second consumption rate is greater than the threshold value, the correction is not performed in accordance with the respective first consumption rate and the second consumption rate.

* * * * *